US007472915B2

(12) United States Patent
Syrkos

(10) Patent No.: US 7,472,915 B2
(45) Date of Patent: Jan. 6, 2009

(54) SPEED CONTROL DEVICE

(75) Inventor: Yves Syrkos, Blainville (CA)

(73) Assignee: Quebec Inc./Syrkoss, Blainville (Quebec) (CA)

( * ) Notice: Subject to any disclaimer, the term of this patent is extended or adjusted under 35 U.S.C. 154(b) by 565 days.

(21) Appl. No.: 11/180,541

(22) Filed: Jul. 14, 2005

(65) Prior Publication Data

US 2007/0013153 A1 Jan. 18, 2007

(51) Int. Cl.
*A63C 17/12* (2006.01)
*A63C 17/14* (2006.01)

(52) U.S. Cl. ..... 280/11.204; 280/11.211

(58) Field of Classification Search ..... 280/11.204, 280/11.206, 11.211, 11.221, 11.232
See application file for complete search history.

(56) References Cited

U.S. PATENT DOCUMENTS 5,401,038 A * 3/1995 Peck et al. ..... 280/11.206
5,657,999 A * 8/1997 Beaulieu ..... 280/11.207
5,752,707 A * 5/1998 Cottle et al. ..... 280/11.214
5,997,015 A 12/1999 Bellehumeur
6,010,136 A 1/2000 Hoskin
6,065,761 A 5/2000 Gignoux et al.
6,105,976 A * 8/2000 Cottle ..... 280/11.216
6,116,621 A 9/2000 Flater
6,131,922 A 10/2000 Klukos
6,217,038 B1 4/2001 Moe
6,283,481 B1 9/2001 Roman et al.
6,412,792 B1 7/2002 Hoskin
6,435,525 B1 8/2002 Penicaut
6,536,783 B2 3/2003 Gorza et al.
6,598,887 B2 7/2003 Haldemann
6,874,794 B2 4/2005 Holland
6,955,360 B2 * 10/2005 Krivulin ..... 280/11.206

* cited by examiner

*Primary Examiner*—Christopher Ellis
*Assistant Examiner*—Joseph Rocca
(74) *Attorney, Agent, or Firm*—Equinox Protection; Franz Bonsang, Patent Agent

(57) ABSTRACT

A speed control device suitable for roller skates includes a wedge-shaped floating brake pad actuable into an operative mode in a frictional contact with a disc secured to a blade wheel by means of an actuating lever movable in a controlled manner through the agency of mating scroll formations. The brake pad being configured and sized to, once frictionally engaged with the disc, remain engaged therewith until rotation of the wheel substantially ceases.

17 Claims, 3 Drawing Sheets

SPEED CONTROL DEVICE

FIELD OF THE INVENTION

The present invention relates to a speed control device and in particular, but not exclusively, has reference to such a device suitable for use on a roller skate, more especially a roller blade.

BACKGROUND OF THE INVENTION

In-line roller blades are now in common use and, for recreational and even practical purposes, have virtually supplanted the conventional roller skates of yore. Roller blades typically include a boot portion to house the foot of the user comfortably surmounting a narrow frame running along the base of the boot to accommodate a number of wheels aligned for rotation along a common plane. It is relatively commonplace for some form of braking device to be connected to the rear part of the frame, but they demand some degree of acquired skill and coordination for effective and safe operation. In some models, the device requires the user to raise the front part of the skate to engage a brake pad located at the back part of the skate with the skating (ground) surface. The brake pad thus undergoes varying degrees of deterioration from abrasion depending upon the characteristics of the interacting surfaces.

The operation of such conventional braking devices is an acquired skill for novices to the degree that loss of balance and subsequent injury are not uncommon during the learning process. Typically, the user may not apply enough pressure to the brake pad resulting in too slow a stop or conversely, in applying excessive pressure too abrupt a halt would be achieved and both extremes could result in loss of control with possible injury. For example, when going downhill, it is almost impossible for a user to continuously maintain the brake in operation with the front part of the skate raised, especially for a beginner level skater that could easily panic and injure himself before reaching the low bottom of the hill. In addition, most braking devices being non-adjustable may have too sharp an efficiency curve thereby precluding any gradual speed reducing effect and again the user needs to acquire the requisite skills on a trial and error basis. Some other forms of braking device provide for the application of a braking pressure on the running surface of the wheels, often resulting in damage and deterioration of the wheels with a concomitant and high replacement cost. Furthermore, the absence of any adjustment capability precludes any opportunity on the part of the user to become adept quickly at the deployment of the braking device. Moreover, the lack of adjustability means that the device cannot cater for fluctuating weather conditions that affect blading performance. Finally, braking devices are usually an integral part of the roller blade and thus cannot be changed.

Accordingly, there is a need for an improved speed control/braking device suitable for roller skates, more especially roller blades.

SUMMARY OF THE INVENTION

It is therefore an object of the present invention to provide an improved speed control device for roller skates.

An advantage of the present invention is that the speed control device for the skate engages a wheel to provide gentle and gradual decelerative action thus avoiding premature deterioration of the friction pads and/or user-controlled speed deceleration.

Another advantage of the present invention is that the speed control device allows for adjustment to accord with the physical characteristics of the skate, the personal skill level of the user and prevailing weather conditions.

A further advantage of the invention resides in the contact as between the frictional pad and the wheel to give, upon actuation of the device a controlled decelerative effect gradually to bring the wheel and thus the skate to a stop.

A still further advantage of the present invention is that the speed control device is capable of automatic disengagement from the wheel when the latter has become stationary at the complete stop of the skate or when the braking wheel is momentarily disengaged from the ground surface.

Another advantage of the present invention is that the speed control device is activated by the user only once, raising the front portion of the skate (as typically with ground engaging brakes), but once engaged the device remains engaged during rotation of the wheel.

Still another advantage of the invention is that the speed control device, once in operation after activation, allows the user to remain stable on the skates with all wheels engaging the ground surface while the device remains in operation.

A further advantage of the invention resides in its capacity for retrofitting most existing in-line roller skates or blades.

A still further advantage of the present invention is that it provides for a smooth and controlled retardatory effect, such as controlled by the actual weight applied to the braking wheel during operation of the device.

Yet another advantage of the invention is that the speed control device can be used with wheels of different sizes, ultimately with the use of a length adjustable activation lever.

According to the present invention there is provided a speed control device suitable for use with roller skates or the like each skate having at least a wheel, the device comprising a brake pad frictionally engageable in use with a surface of or on the wheel, and an actuator adapted upon activation to initiate motion of the brake pad towards said surface and to cause the brake pad gradually to move into frictional engagement with said surface, the brake pad being configured and sized to, once frictionally engaged with the surface, remain engaged therewith until rotation of the wheel substantially ceases, thereby controlling the speed of the wheel and of the roller skate.

Typically, the brake pad includes a braking first pad surface frictionally engageable in use with the surface and a second opposed pad surface in contact engagement with the actuator, the second pad surface being generally angled relative to the first pad surface so as to form a wedge-shaped brake pad tapering in a direction of rotation of the wheel. Conveniently, the second pad surface is generally angled relative to the first pad with an angle in the range of about ten to twenty-five degrees (10° to 25°), and preferably about fifteen degrees (15°)

The actuator may conveniently include a lever suitably orientated for activation into frictional engagement with the ground or the skating surface on which the user is intending to skate. The actuator further includes an axially moveable shaft carrying a male scroll formation rotationally mating with a female scroll formation within a housing rigidly mountable upon the wheel axle. Typically, the actuator further includes a sleeve member having the female scroll formation formed therein for rotational mating with the shaft, the sleeve member axially movably mounted on the housing so as to allow selective axial positioning thereof in relation to the housing for compensation of wearing of the brake pad. The shaft further carries a resiliently biased detent registering with a contoured guideway formed with the back side of the brake pad adjacent the second pad surface and remote from the braking first pad surface thereof. The contour of the guide may be linear, arcuate or curvilinear dependent upon the performance required of the speed control device. Travel of the detent against the action of the bias within the guide after activation of the device by action of the lever contacting the ground, occasions further but gradual engagement of the brake pad with the wheel thereby causing controlled retardation. The brake pad floats within the housing of the device and is thus slowly squeezed onto the wheel. The guide and the back surface of the pad may be provided with a coating of or formed of a low friction material to reduce wear.

A pressure plate may be provided intermediate the shaft and the back side of the brake pad.

A disc may be provided for mounting on the relevant rear wheel of the roller skate to provide a braking surface with which the brake pad in operation may make contact for effecting speed control.

The clearance between the brake pad and the disc may be variably adjusted and in this regard the sleeve may be externally threaded for mating engagement with a boss provided on the housing and is conveniently provided with a locking collar for retaining the sleeve in the selected position.

The orientation of the lever may be positionally adjustable on the shaft and in this respect the end of the shaft may be provided with splines or flutes thereby to allow differing angular positions of the lever relative thereto, dependent upon individual requirements. The nearer the initial inoperative position of the lever to the ground the swifter will be the operation of the speed control device upon actuation of the lever by the user. This setting would be convenient for a novice roller skater. Conversely, the greater the initial distance of the lever from the ground the greater will be delay of activation of the speed control device, and this setting would be more appropriate for an experienced user.

The angular orientation of the axis of the shaft of the speed control device in relation to the wheel axis conveniently lies in the range of about ten to twenty-five degrees (10° to 25°) and as a preference is about fifteen degrees (15°).

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

Figure 1:
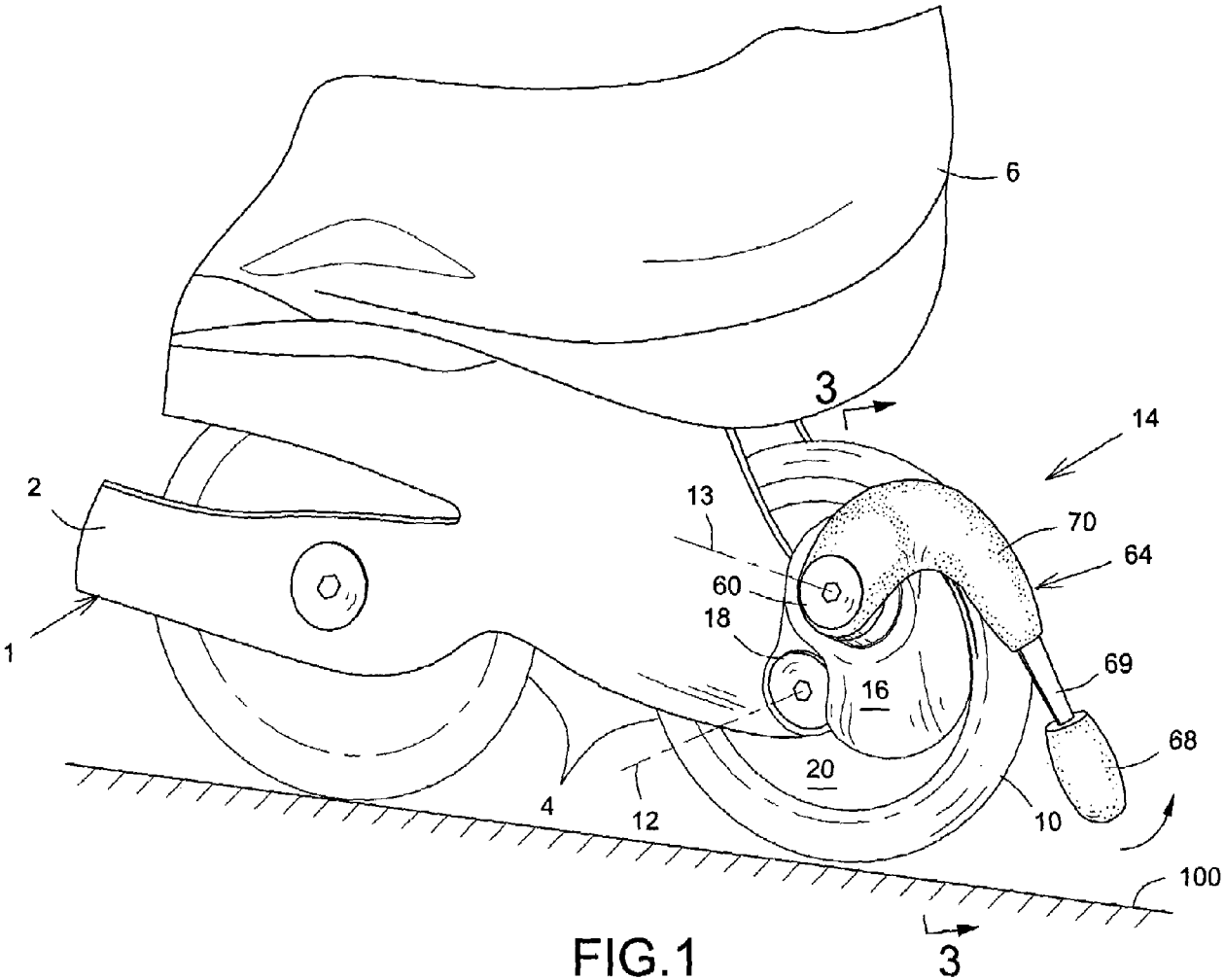
FIG. 1 is a simplified rear perspective view showing a speed control device in accordance with the present invention mounted on a roller skate partially depicted in an upright ground-engaging position.

With reference to the annexed drawings the preferred embodiments of the present invention will be herein described for indicative purpose and by no means as of limitation.

Referring to the drawings, a speed control device 14 in accordance with an embodiment of the present invention is shown in relation to a roller skate blade only part of which is generally shown at 1 including a wheel frame 2 provided with a number of wheels 4 only two being illustrated in the drawing for the sake of clarity. Surmounting the frame 2 is a boot 6 for accommodation of a user's foot.

The rearmost wheel 10 is rotatably mounted on a fixed axle 12, as is a speed control device 14 a housing 16 of which is secured to the axle 12 by means of a screw 18. A brake disc 20 is typically affixed to the hub 22 of the wheel 10 by means of a mounting ring 24 and suitably secured by three screws 26.

Figure 3:
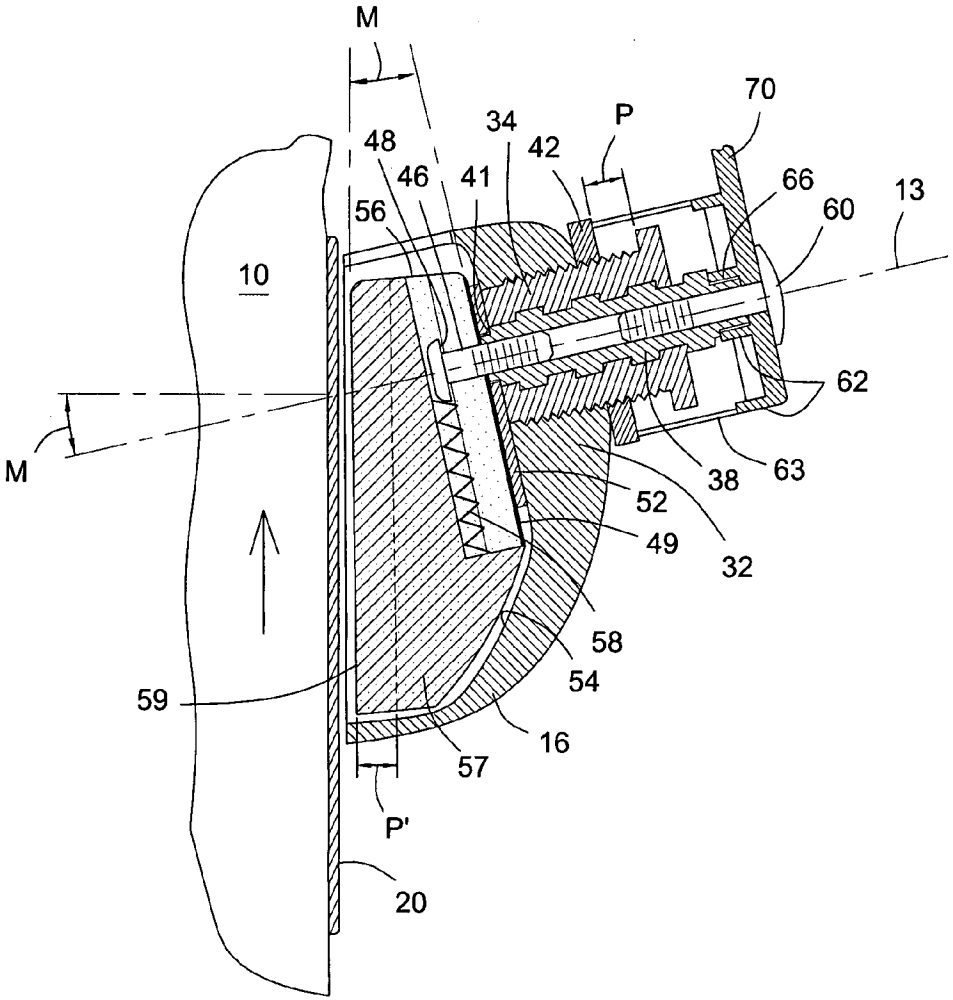
FIG. 3 is a simplified enlarged section view taken on the line 3-3 of FIG. 2, showing the embodiment in the idle position with the brake pad spaced from the brake disc.

The housing 16 of the device 14 has a brake mechanism 30 or actuator eccentrically and typically angularly mounted in relation to the axle 12 and provides an internally threaded boss 32, typically for reception of a sleeve 34 having formed therewithin a female scroll 36 of significant pitch for mating with a male scroll 38 on a shaft 40, all on a brake axis 13. A locking collar 42 with a knurled periphery 43 is arranged externally of the sleeve 34 which is suitably threaded as at 44 for that purpose. The angular mounting M of the mechanism 30 lies in the range of about ten to twenty-five degrees (10° to 25°), as shown in FIG. 3, and is preferably about fifteen degrees (15°).

Figure 2:
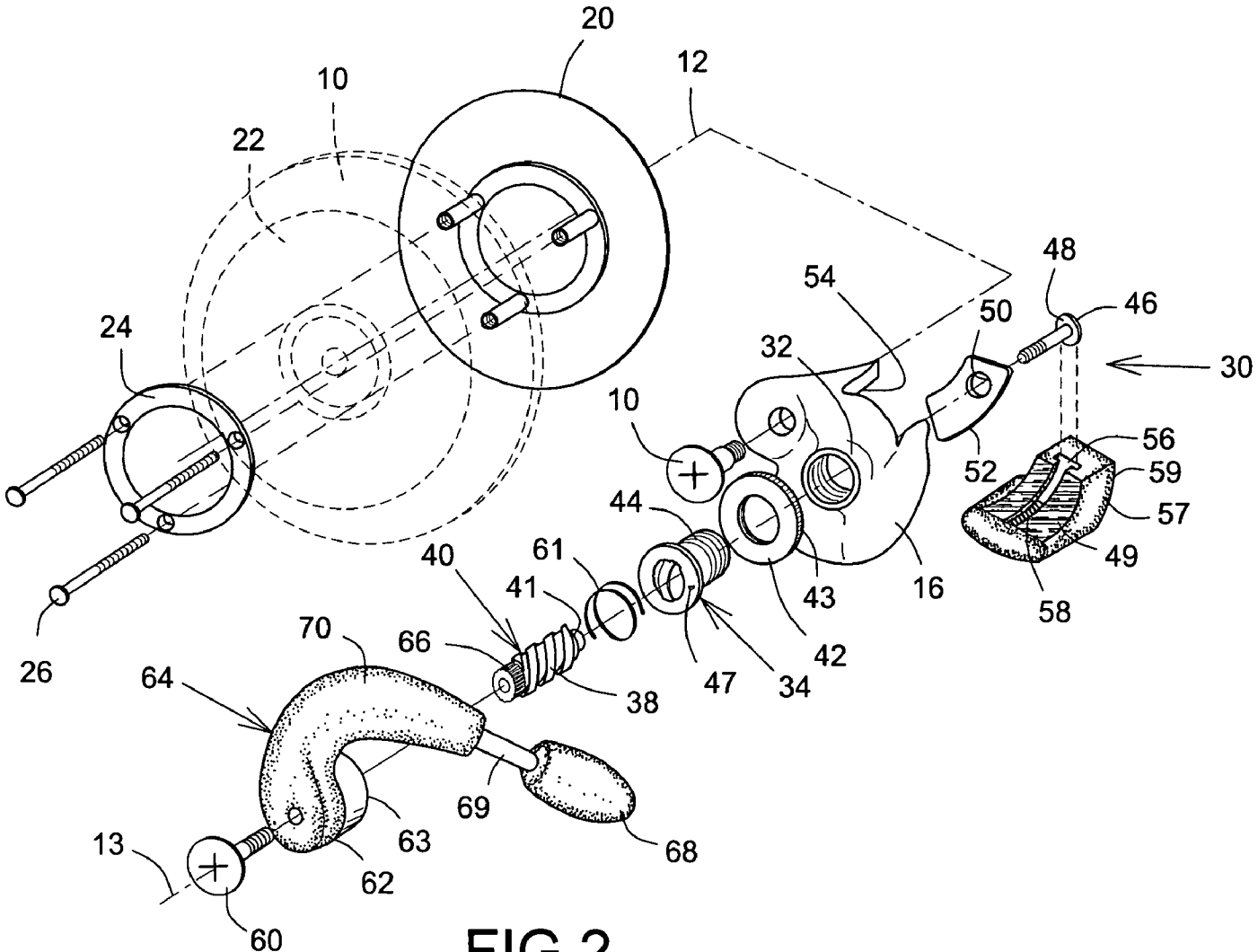
FIG. 2 is a simplified exploded perspective view of the embodiment shown in FIG. 1 with the roller skate wheel shown in dotted outline.
Figure 4:
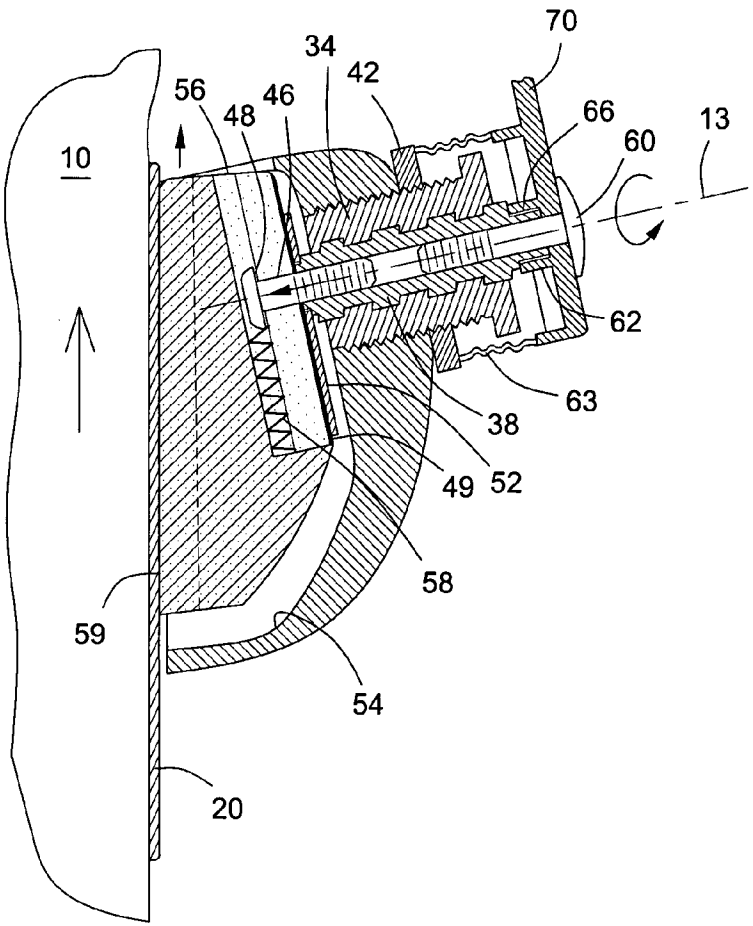
FIG. 4 is a view similar to that of FIG. 3 showing the embodiment in an operating position with the brake pad frictionally engaging the disc.

The shaft 40 is internally bored and threaded and accommodates at its relatively inner end a threaded pin 46, relatively loosely secured to the shaft 40, with a head 48 which extends through an aperture 50 provided in a pressure plate 52 which floats about a shoulder 41 of shaft 40 coaxial with the pin 46, but is retained in its general position by a cooperating shaped relief 54 in the housing as shown in FIG. 2. The pin head 48 registers within a contoured guide slot 56 or guideway formed in a back side 49 of a wedge-shaped and typically arcuate (to substantially follow the shape of the disc 20) brake pad 57, angled with the opposite barking front side 59 thereof with angle M, which slot accommodates a resilient bias in the form of an open coiled compression spring 58 providing a bias for the head 48. In the inoperative position of the speed control device, the brake pad 57 is distanced from the disc 20 as shown in FIG. 3. The pressure plate 52 abuttingly contacts the back side 49 of the brake pad 57 as can be seen in FIGS. 3 and 4. The interaction of the guide slot 56 and the pin head 48 essentially effects a controlled movement to the brake pad 57 into contact with the disc 20 in a manner to be explained below. To enhance the sliding movement between the pressure plate 52 and the back side 49 of the pad 57 during operation of the device 14, the back side 49 is typically covered or coated with a frictionless type material, e.g. an aluminum tape or the like.

At the relatively outer end of the shaft the internal bore accommodates a securing screw 60 which fixes thereto a mount 62 for an actuating lever 64. The mount 62 is internally splined (not shown) for registration with a mating spline 66 on the end of the shaft 40 thus allowing the angular disposition of the mount 62 to be varied in relation to axis 13 of the shaft 40. A biasing circumferential and compression spring 61 typically axially mounts between the mount 62 and the locking collar 42, as seen in FIG. 2 (the spring 61 is not shown in FIGS. 3 and 4 for the sake of clarity), preferably provided with a spring radial abutment protrusion 47 or the like, to bias the outer end of shaft 40 away from the housing 16 and collar 42 with the lever 64 towards its idle position. The biasing spring 61 also damps the vibrations of the lever 64 in the idle position. In order to enable the mounting of the device 14 on wheels of different diameters, the lever 64 could be adjustable in length (not shown).

The lever 64 comprises three parts, namely a ground contact element 68 made of a suitable material for frictional engagement with the ground 100, a second or intermediate rigid arm 69 which engages a third part 70 of relatively rigid elastomeric material, e.g. rubber. The part 70 is integral with the mount 62 from which extends a skirt 63 for protecting the overall speed control device from the ingress of injurious materials, for example dust and grime. The skirt 63 may abut the locking collar 42 and/or the boss 32 without inhibiting relative movement of the operative parts.

In operation, a user (not shown) wearing a pair of roller skate blades and wishing to control the forward speed is enabled to bring about a retardatory effect by means of the speed control device 14 in the following manner. The user tilts toe part of the blade 1 upwardly such that the actuating lever 64 is carried downwardly by the wheel frame 2 whereby the contact element 68 abuts the ground 100 (FIG. 1) thus causing the lever to rotate in the direction by the arrow shown in that drawing. This rotation of the lever 64 causes the shaft 40 to move axially by dint of the interaction of the mating scrolls 36 and 38 and in so doing the pin 46 and its head 48 are carried towards the rearmost wheel 10, namely to the left as viewed in FIG. 3. The action of the pin and its head 58 integral with the shaft 40 causes the brake pad 57 to move gradually into frictional engagement with the disc 20 and the initial interengagement occasions a circumferential sliding of the pad 57 which forces the pin to move further within its guide slot 56 formed in the pad 57 (FIG. 4), being pressured to follow the path defined therein against the bias of the spring 58 which also smoothers the gradual contact of the pad 57 against the disc 20. By the angled position of the pressure plate 52 in abutment engagement with the back side 49 of the wedge shape of the pad 57 this sliding movement of the pad 57 partially turns into a further axial movement of the pad 57 thereby gradually increasing frictional pressure on the pad 57 into a greater decelerative position onto the disc. Once this axial movement of the shaft 40 is initiated, it continues until the wheel is brought to rest. The wedge shape of the pad 57 assists in the controlled pressure and retardatory effect to give speed control by essentially squeezing the pad 57 into contact with the disc. The wedge shape of the pad 57 essentially provides for this squeezing effect thereof between the disc 20 and the pressure plate 52 of the actuator 30 to allow the pad 57, once frictionally engaged to the disc 20, to remain engaged therewith until the rotation of the wheel substantially ceases. As can be seen in FIGS. 3 and 4, the pad 57 floats with the wheel 10 to give this squeezing effect, the floating pressure plate 52 assisting in this regard. Whenever the squeezing effect gets relatively large, the pad 57 tends to push the pressure plate 52 and the housing 16 axially away from the wheel 10, thereby preventing the pad 57 from completely blocking the rotation of the wheel 10.

Once the pad 57 is in frictional engagement with the disc 20, the loose mounting of the shaft 40 to the pad 57 allows for the lever 64 to slightly rotate back towards its idle position under the action of the biasing spring 61.

Once the wheel 10 and thus the roller skate 1 have come to rest, the spring 58 automatically repositions the pad 57 into an idle position as shown in FIG. 3, namely into a disengaged state with respect to the disc 20.

The present invention provides controlled speed retardation of roller blade skate and thus differs from the crude brake as such. The gradual application of pressure on the pad to engage the disc seeks to ensure a safe but effective decelerative result coupled with an automatic resetting following arrest of the wheel.

The invention further allows modulation of the rate of speed control in accordance with the skill of the user and thus certain components may be adjusted angularly to give the desired effect. Additionally any wear on the brake pad 57 may be accommodated by suitable resetting of the sleeve 34 and the locking collar 42. Accordingly, the available axial play of the locking collar 42 relative to the housing 16, as outlined by distance P in FIG. 3, provides for the maximum acceptable wear P' of the brake pad 57, as outlined by the recessed broken line in FIG. 3.

It is to be noted that above-mentioned threaded components, preferably all but at least the main shaft 40 (mating scroll 36, 38 formations) and the sleeve 44 cooperating with the internally threaded boss 32, will need to be left threaded when the device 14 is being mounted on the left hand side of the wheel, as illustrated in FIGS. 1 to 4. In the opposite (not shown), when the device 14 is being mounted on the right hand side of the wheel, the threaded components will need to be right threaded with conventional threads.

Although not illustrated herein, it would be to one skilled in the art that the female scroll could be directly formed within the boss 32 of the housing 16, instead of the sleeve thread, with no wear adjustment pieces, namely the sleeve 34 and the locking collar 42, without departing from the scope of the present invention. Accordingly, other types of wear compensation adjustment mechanisms could be considered, such as ratchet-type adjustments or the like.

Although not illustrated herein, it would be to one skilled in the art that the brake mechanism 30 could be eccentrically mounted and substantially in parallel in relation to the axle 12 without departing from the scope of the present invention, as long as the surface contacting and pushing on the back side 49 of the brake pad 57, namely the pressure plate 52, is tapered and provided with an angled surface to cooperate with the wedge-shaped pad 57.

It will be understood that whilst the present invention has been described as being particularly applicable to roller skates of the blade type, it may also be used on other wheeled or roller devices, such as a grocery cart, stretcher or the like. On the other roller devices, since the roller device may not be partially raised to activate the lever the speed control device could be mounted on include a different activation system in replacement of the lever, such as a conventional bicycle brake handle with corresponding cable or the like, and, accordingly, be mounted on anyone of the wheels.

Although the present speed control device for a roller skate has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A speed control device suitable for use with roller skates or the like each skate having at least a wheel, the device comprising a brake pad frictionally engageable in use with a surface of or on the wheel, and an actuator adapted upon activation to initiate motion of the brake pad towards said surface and to cause the brake pad gradually to move into frictional engagement with said surface, the brake pad being substantially axially and circumferentially movable relative to a housing of the actuator rigidly mountable upon the axle of the wheel, the brake pad including a braking first pad surface frictionally engageable in use with the surface and a second opposed pad surface in contact engagement with the actuator, the second pad surface being generally angled relative to the first pad surface so as to form a wedge-shaped brake pad tapering in a direction of rotation of the wheel, the brake pad further including a guideway substantially circumferentially formed in a back side of the brake pad adjacent the second pad surface and remote from the braking first pad surface thereof and being in registration with the actuator, the brake pad, once frictionally engaged with the wheel surface, partially circumferentially moves to remain engaged therewith rotation of the wheel substantially ceases, thereby controlling the speed of the wheel and of the roller skate.

2. The device of claim 1, wherein the actuator includes a lever orientated for activation into frictional engagement with the skating surface.

3. The device of claim 2, wherein the actuator further includes a female scroll a female scroll formation within the housing, and an axially moveable shaft carrying a male scroll formation rotationally mating with the female scroll formation, the lever being rigid with the shaft.

4. The device of claim 3, wherein the actuator further includes a sleeve member having the female scroll formation formed therein for rotational mating with the shaft, the sleeve member axially movably mounted on the housing so as to allow selective axial positioning thereof in relation to the housing for compensation of wearing of the brake pad.

5. The device of claim 3, wherein the lever is angularly adjustable on the shaft.

6. The device of claim 5, wherein the lever is attached to the shaft through the agency of a splined mount.

7. The device of claim 6, wherein the splined mount is incorporated in an elastomeric limb forming part of the lever.

8. The device of claim 7, wherein the lever carries a ground-engaging element.

9. The device of claim 3, wherein the axially moveable shaft carries a resiliently and circumferentially biased detent registering with the guideway being contoured.

10. The device of claim 3, wherein the axially moveable shaft has an axis of orientation in relation to the axis of rotation of the wheel lying in the range of about ten to twenty-five degrees (10° to 25°).

11. The device of claim 10, wherein the axis of orientation of the axially moveable shaft is about fifteen degrees (15°) in relation to the axis of rotation of the wheel.

12. The device of claim 3, wherein a pressure plate is provided intermediate the shaft and the brake pad.

13. The device of claim 12, wherein the pressure plate is adapted to contact the back side of the brake pad and to float in relation thereto.

14. The device of claim 1, wherein the brake pad is adapted to float within the housing.

15. The device of claim 1, wherein the surface of or on the wheel is formed by a disc secured axially to the wheel.

16. The device of claim 1, wherein the second pad surface is generally angled relative to the first pad with an angle in the range of about ten to twenty-five degrees (10° to 25°).

17. The device of claim 16, wherein the second pad surface is generally angled relative to the first pad with an angle of about fifteen degrees (15°).

* * * * *

UNITED STATES PATENT AND TRADEMARK OFFICE

CERTIFICATE OF CORRECTION

PATENT NO. : 7,472,915 B2
APPLICATION NO. : 11/180541
DATED : January 6, 2009
INVENTOR(S) : Yves Syrkos It is certified that error appears in the above-identified patent and that said Letters Patent is hereby corrected as shown below:

Title page, item [73], Assignee: should read -- 9058-3717 Quebec Inc./Syrkoss --

Signed and Sealed this

Tenth Day of March, 2009

JOHN DOLL
*Acting Director of the United States Patent and Trademark Office*